United States Patent [19]

Howe

[11] Patent Number: 4,904,315

[45] Date of Patent: Feb. 27, 1990

[54] METHOD FOR IMPROVING MAGNESIUM OXIDE STEEL COATINGS USING NON-AQUEOUS SOLVENTS

[75] Inventor: Michael W. Howe, Pittsburgh, Pa.

[73] Assignee: Marine Magnesium Company, Corapolis, Pa.

[21] Appl. No.: 287,936

[22] Filed: Dec. 20, 1988

Related U.S. Application Data

[60] Continuation of Ser. No. 176,572, Apr. 1, 1988, Pat. No. 4,799,969, which is a division of Ser. No. 45,490, May 4, 1987, Pat. No. 4,753,687.

[51] Int. Cl.[4] ..... C23C 22/02

[52] U.S. Cl. ..... 148/245

[58] Field of Search ..... 148/113, 245

[56] References Cited

U.S. PATENT DOCUMENTS 3,956,030 5/1976 Lee ..... 141/113

FOREIGN PATENT DOCUMENTS 0258477 12/1985 Japan ..... 148/113

*Primary Examiner*—Sam Silverberg

*Attorney, Agent, or Firm*—Reed Smith Shaw & McClay

[57] ABSTRACT

This invention is directed to non-aqueous magnesium oxide slurries and the use thereof to coat silicon steels prior to high temperature annealing.

1 Claim, No Drawings

METHOD FOR IMPROVING MAGNESIUM OXIDE STEEL COATINGS USING NON-AQUEOUS SOLVENTS

This is a continuation of application Ser. No. 176,572, filed Apr. 1, 1988, now U.S. Pat. No. 4,799,969 which is a division of Ser. No. 045,490 filed on May 4, 1987, now U.S. Pat. No. 4,753,687.

BACKGROUND OF THE INVENTION

In many fields of use and, in particular, in the electrical industry, it is necessary to coat a ferrous metal. Such a coating desirably performs the function of separating and purifying the ferrous material and reacting with surface silica in the steel to form an electrical insulating layer.

For example, in the transformer art, the cores of transformers are usually formed of a ferrous material, such as silicon steel, which may be provided with a preferred grain growth orientation through annealing to provide optimal electrical and magnetic properties. It is necessary to provide a coating on the ferrous material prior to the final high temperature grain growth anneal. This coating performs three functions, including: separating the various turns or layers of the coiled material to prevent their sticking or welding together during high temperature annealing; aiding in the chemical purification of the ferrous material to develop desired optimum characteristics of the metal; and forming on the surface of the ferrous material being treated a refractory-type coating which electrically insulates one layer of ferrous material from the next during its use as a transformer or an electrical apparatus such as a motor armature or the like.

In the present state of the electrical apparatus art, the most widely used coating for a ferrous-containing material is a coating of magnesium oxide and/or magnesium hydroxide. These coatings are generally applied to the ferrous material in the form of a slurry or suspension of magnesium oxide and/or magnesium hydroxide in water. These slurries or suspensions (slurry and suspension are used synonomously herein) comprise a quantity of magnesium oxide or magnesium hydroxide in water, and are mixed sufficiently for the desired application.

The inventor has found that improved magnesium oxide coatings are obtained using non-aqueous magnesium oxide and/or magnesium hydroxide slurries. The use of non-aqueous solvents to prepare magnesium oxide slurries for application to steel represents a novel approach which offers unexpected benefits, including reduction or elimination of "tight magnesia" and an improved glassy coating.

As set forth in U.S. Pat. No. 2,385,332, during heat treatment at suitable temperatures, magnesium oxide can be caused to react with silica particles on or near the surface of a previously oxidized silicon-iron sheet stock to form a glass-like coating. Such coatings are useful as interlaminary insulators when silicon-iron sheets are used in electrical apparatuses, as for example in the core of a transformer.

In the production of silicon steel for the magnetic cores of transformers, the steel is generally annealed to provide optimum grain growth orientation which develops the magnetic properties of silicon steel. This anneal, which is usually carried out in a dry hydrogen atmosphere at high temperatures, also aids in purifying the steel. During annealing, the magnesium oxide in the added slurry or suspension reacts with silica on the surface of the silicon steel to form a glass-like coating of magnesium silicate. This glass-like coating provides electrical insulation during the use of the silicon steel in electrical apparatuses.

U.S. Pat. No. 4,512,823 describes magnesium oxide compositions which eliminate "tight magnesia", or excess magnesium oxide which adheres tightly to the annealed coating (glass film) formed on silicon steels, while minimizing the hydration rate in the aqueous coating bath. More particularly, a portion of the magnesium oxide in the coating slurry or suspension reacts with the surface silica to form a glass-like magnesium silicate coating, while the unreacted portion remains as excess magnesium oxide which must be removed prior to further processing. Generally, this removal is accomplished by mechanical scrubbing with nylon bristle brushes or the like. After scrubbing, if there is a residue, it is termed "tight magnesia" and is undesirable. The method of the 4,512,823 patent utilizes admixtures of barium oxide, barium nitrate, chromium nitrate, or their hydrates with magnesium oxide in an aqueous slurry to minimize the formation of "tight magnesia", thereby improving the stacking factor of the steel and improving production yield by lessening the quantities of unacceptable steel caused by "tight magnesia" deposits.

The instant invention represents a distinct method for minimizing "tight magnesia". More particularly, non-aqueous slurries of magnesium oxide are added, instead of aqueous slurries, to steel prior to annealing. When the coated steel is annealed, "tight magnesia" formation is greatly reduced or eliminated, and the resulting glass-like film is improved.

The distinction between this invention and the prior art is that the instant magnesium oxide slurries are non-aqueous. The inventor has discovered that the formation of "tight magnesia" is related, by some mechanism, to the presence of water during annealing. The use of non-aqueous solvents eliminates the major source of water.

DESCRIPTION OF THE INVENTION

The instant invention is directed to an improved slurry for use in the initial coating of silicon steel prior to high temperature annealing, comprising: a) 0.1–20%, by weight, magnesium oxide; and b) the balance a non-aqueous solvent in which said magnesium oxide is insoluble.

The instant invention is also directed to an improved process for coating silicon steel, comprising coating the steel with a magnesium oxide slurry prior to high temperature annealing, wherein said magnesium oxide slurry comprises: a) 0.1–20%, by weight, mangesium oxide; and b) the balance a non-aqueous solvent in which said magnesium oxide is insoluble.

Any non-aqueous solvent in which magnesium oxide is insoluble can be used. As used herein, the term non-aqueous solvent includes organic solvents which are capable of suspending magnesium oxide, including aromatic hydrocarbons, aliphatic hydrocarbons, alcohols, aldehydes, ketones, amines, esters, ethers, glycols, glycol ethers, alkyl halides and aromatic halides. Organic acids generally dissolve magnesium oxide, and are therefore unacceptable.

Non-aqueous solvents also include compositions which comprise the above defined solvents and water. The inventor has discovered that the addition of up to 60%, by weight, water to organic solvents in some instances does not adversely affect the formation of tight magnesia, while minimizing operating costs and lowering solvent flash points.

The preferred solvents include alcohols, glycol ethers and alkyl halides. For example, preferred alcohols include straight and branched $C_1$, $C_1$ alcohols, especially methanol, ethanol, n-propyl alcohol, isopropyl alcohol, butanol and isomers of butanol. Preferred glycol ethers include ethylene glycol monoether, methyl ethylene glycol monoethyl ether and diethylene glycol monomethyl ether. Preferred alkyl halide are carbon tetrachloride and methylene chloride.

The magnesium oxide comprises 0.1 to 20%, by weight, of the non-aqueous slurry. Preferably, magnesium oxide comprises about 5 to about 20%, by weight, and most preferably about 8–15%, by weight.

High temperature annealing provides optimum grain growth orientation, which develops the magnetic properties of silicon steel. Annealing is usually carried out in a dry hydrogen atmosphere, at a temperature ranging from about 950° to about 1500° C., for about 2 to about 50 hours. Use of the instant non-aqueous magnesium oxide slurries prior to annealing minimizes or eliminates "tight magnesia" and improves the magnesium silicate glassy coating formed during annealing.

EXAMPLES

The following examples illustrate the instant invention in greater detail. They are not intended, however, to limit the scope of the instant invention in any way.

EXAMPLES 1–5

These examples illustrate the use of pure non-aqueous solvent/magnesium oxide slurries to reduce tight magnesia.

Maglite S3334 is calcined magnesium oxide, available from Calgon Corporation, Pittsburgh, PA.

The calcined material was made into a slurry with the non-aqueous solvents listed in Table I. Slurry concentrations are shown in the table. The slurries were coated on panels of decarburized silicon steel. The slurry coated steel was then dried at about 200° to 220° C. The resulting coating had a coating weight of about 0.033 ounce/ft$^2$. The coated panels were then annealed in a dry hydrogen atmosphere at about 1150° C. for about 30 hours. The panels were then cooled and scrubbed using nylon brushes and water at about 130° F. After scrubbing, the annealed steel was inspected and the amount of residual magnesium oxide was determined.

In Table I, the following terms are used to describe the performance of calcination-modified magnesium oxides:

Annealed Adherence—Measures the tenacity with which excess MgO adheres to a glass layer. The adherence is ranked 1–5 (loose to tight). This is the measure of tight magnesia; low annealed adherence values are desired.

Franklin Test—The resistance of the glass coating to the flow of electrical current. The values reported are the amperage at 0.5 volts DC. The lower the amperage the better the resistivity and consequently the better the glass (i.e., ≧0.90 is a dead short-no insulating by the glass film).

TABLE 1

| Example Number | Solvent | Slurry Concentration (g/l) | Annealed Adherence | Franklin test (AMPS) |
|---|---|---|---|---|
| 1 Comparison Example | Water | 180 | 5 | .89+ |
| 2 | Ethylene* Glycol Monobutyl Ether | 180 | 1 | .65 |
| 3 | Isopropyl Alcohol | 180 | 1 | .61 |
| 4 | Methanol | 180 | 3 | — |
| 5 | Ethylene Glycol | 180 | 2 | — |

*Commercially avaiable as Cellosolve.
+Average of two tests.

EXAMPLES 6–14

These examples illustrate the use of organic solvent-/water/magnesium oxide slurries to reduce tight magnesia. Operating costs are lowered by replacing pure solvent with water, and the addition of water lowers solvent flash points. The organic solvent:water ratios are weight:weight ratios.

TABLE 2

| Example Number | Solvent | Slurry Concentration (g/l) | Annealed Adherence | Franklin Test (AMPS) |
|---|---|---|---|---|
| 6 | 50:50 Ethylene Glycol Monobutyl Ether:Water | 180 | 1 | .62 |
| 7 | 40:60 Ethylene Glycol Monobutyl Ether:Water | 180 | 1 | — |
| 8 | 30:70 Ethylene Glycol Monobutyl Ether:Water | 180 | 2–2.5 | — |
| 9 | 25:75 Ethylene Glycol Monobutyl Ether:Water | 180 | — | .81 |
| 10 | 95:5 Isopropyl Alcohol:Water | 180 | 2 | — |
| 11 | 90:10 Isopropyl Alcohol:Water | 180 | 1 | — |
| 12 | 85:15 Isopropyl Alcohol:Water | 180 | 2–2.5 | — |
| 13 | 50:50 Isopropyl Alcohol:water | 180 | — | .83 |
| 14 | 90:10 Methanol: Water | 180 | 4.4.5 | — |

What is claimed is:

1. A method for coating silicon steel, comprising initially coating the steel, prior to high temperature annealing, with a slurry comprising: 0.1 to 20%, by weight, magnesium oxide, and b) the balance a non-aqueous solvent in which said magnesium oxide is insoluble.

* * * * *